United States Patent [19]

Barber

[11] Patent Number: 4,461,681

[45] Date of Patent: Jul. 24, 1984

[54] PROCESS FOR THE PREPARATION OF SQUARIC ACID BY THE ELECTROLYSIS OF CARBON MONOXIDE IN ANHYDROUS ALIPHATIC NITRILE SOLVENT MEDIA

[75] Inventor: James J. Barber, Montvale, N.J.

[73] Assignee: The Halcon SD Group, Inc., New York, N.Y.

[21] Appl. No.: 499,575

[22] Filed: May 31, 1983

[51] Int. Cl.[3] ..... C07B 29/06

[52] U.S. Cl. ..... 204/59 R

[58] Field of Search ..... 204/59 R, 59 QM

[56] References Cited

U.S. PATENT DOCUMENTS 3,833,489 9/1974 Ercoli et al. ..... 204/59 QM

OTHER PUBLICATIONS

Silvestri et al., Gazzetta Chimica Italiana, vol. 102, pp. 818–821, (1972).

Silvestri et al., Electrochimica Acta, vol. 23, pp. 413–417, (1978).

*Primary Examiner*—John F. Niebling

*Attorney, Agent, or Firm*—William C. Long; Riggs T. Stewart; Daniel R. Zirker

[57] ABSTRACT

An improved process for the preparation of squaric acid, its complexes and/or salts, by means of a process for the electrolytic cathodic reductive tetramerization of carbon monoxide, involving the usage of an anhydrous aliphatic nitrile solvent containing from 3 to about 8 carbon atoms.

19 Claims, No Drawings

PROCESS FOR THE PREPARATION OF SQUARIC ACID BY THE ELECTROLYSIS OF CARBON MONOXIDE IN ANHYDROUS ALIPHATIC NITRILE SOLVENT MEDIA

BACKGROUND OF INVENTION

1. Field of Invention

This invention is related to a process for the preparation of "squaric acid" (dihydroxycyclobutenedione), the compound having the formula:

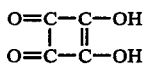

together with the preparation of its complexes and salts. More particularly, the present invention is related to the preparation of these compounds through the reductive electrolytic cyclotetramerization of carbon monoxide in anhydrous aliphatic nitrile solvent media. The resultant compounds potentially are useful as intermediates in the preparation of dyes, polymers, virucides, and as sequestering agents.

2. Description of the Prior Art

Squaric acid (I) was first reported synthesized in 1959 by S. Cohen, J. R. Latcher and J. D. Park, J. Am. Chem. Soc., Vol. 81, p. 3480, through the hydrolysis of certain halogenated cyclobutene derivatives. Squaric acid displays a particularly interesting chemistry partially due to its dianion (II):

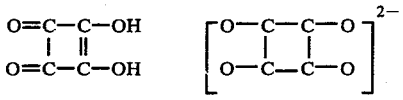

[I] [II]

which may be considered a tetrameric dianion of carbon monoxide, and which has a completely delocalized electronic structure. Consequently, although "phenolic" in nature, the acid is strong ($pK_1=0.6$; $pK_2=3.4$).

In U.S. Pat. No. 3,833,489 ('74) a process for preparing squaric acid, its complexes and its salts is described, together with a short summary of the state of the art at that time. The method involves passing an electric current through a solution of carbon monoxide in a solvent media selected from the group consisting of amides of phosphoric acid, amides of carboxylic aliphatic acids having from 1 to 10 carbon atoms, aliphatic ethers, cyclic ethers, liquid polyethers and anhydrous ammonia, at a temperature of from about −30° C. to a temperature up to the boiling point of said solvent and at pressures up to about 420 atm, in order to thereby cause the electrolytic cathodic reductive cyclotetramerization of the carbon monoxide; the reaction being carried out under conditions of substantial separation or non-interference of the anodic reactions and reaction products from the cathodic reactions and reaction products. Although the patentees attempted to claim as their operative group of solvent compounds all non-aqueous solvents that will conduct current with a minimum of resistance, their actual work has disclosed that only certain amides, ethers, and ammonia are operative, and that many other classes of compounds are ineffective. Furthermore, their system is severely hampered by the fact that subsequent separation of the squaric product from the reaction system is quite difficult, and thus commercial usage of this system is flawed. Other articles by the same researchers (Gazetta Chimica Italiana, Vol. 102, pp. 818–821 ('72) and Electrochimica Acta, Vol. 23, pp. 413–417, ('78)) have also investigated the influence that specific parameters such as the particular solvent, electrolyte, electrode material, carbon monoxide pressure and reaction temperature have on the yield of squaric acid. They determined that there is a great deal of unpredictability involved in this process, particularly in the properties of the particular solvent employed. Of particular interest was their finding that solvents such as acetonitrile gave poor results (about 2% current efficiency) thus leading to their conclusion that nitriles are ineffective as solvents for the production of squaric based compounds. An additional troublesome problem, particularly in a large scale commercial operation, is that the separation of the squaric acid products from the resulting residue is extremely complicated and difficult when solvents such as DMF are employed. In addition, it has been discovered that when using the preferred class of solvents claimed by U.S. Pat. No. 3,833,489 to produce squaric acid, surprisingly large fluctuations in product yields can result even in the case of substantially identical back to back experiments.

It is therefore an object of this invention to develop a simple, effective and economical process for the preparation of squaric acid, its metal complexes and its salts, by the electrochemical reductive cyclotetramerization of carbon monoxide in anhydrous aliphatic nitrile solvents producing consistently high product yields and relatively simple product isolation and extraction.

It is another object of this invention to provide a process for the preparation and recovery of squaric compounds which makes subsequent product recovery much easier and reutilization of unconsumed starting materials feasible.

SUMMARY

Accordingly, the invention involves an improved method for the preparation and recovery of squaric acid, its complexes and its salts, through the passing of an electrical current, e.g., preferably a direct current, although alternating current is operable, through a solution of carbon monoxide maintained within a temperature range spanning the liquid range of the particular solvent, and within a pressure range of about 1–420 atmospheres, and preferably about 30–150 atmospheres, to effect the electrolytic cathodic reductive cyclotetramerization of the carbon monoxide; the improvement comprising undertaking the reaction in a class of anhydrous aliphatic nitrile solvents, each containing from 2 to about 8 carbon atoms, and most preferably, isobutyronitrile. The electrical current causes the reduction of carbon monoxide to the $C_4O_4^{2-}$ squarate ion, the reaction being carried out under process conditions of substantial separation of the anodic reactions or reaction products from, or non-interference of the anodic reactions or reaction products with, the cathodic reactions or reaction products. Upon completion, solids containing substantially all of the squarate formed are isolated by centrifugation or filtration. Recovery of squaric acid, the electrolyte and other raw starting materials is thereby achieved much more easily and efficiently than in earlier systems.

DETAILED DESCRIPTION OF THE INVENTION

The electrochemical cyclotetramerization of carbon monoxide to the squarate ion has been regarded with considerable interest, as the reaction leads from a widely available and inexpensive starting material to an end product $C_4$ molecule which is a potentially useful monomer for certain polyamide type polymers.

However, to date there is still not available a useful commercial process for the volume production of squaric compounds, as is evidenced by its current price of about $1,000/lb. In U.S. Pat. No. 3,833,489 as well as the process of the present invention, the following reaction scheme is apparently used to form squaric acid, most often in the form of an insoluble or unreactive metal squarate salt or complex, using a dissolving metal anode as the source of cations, M:

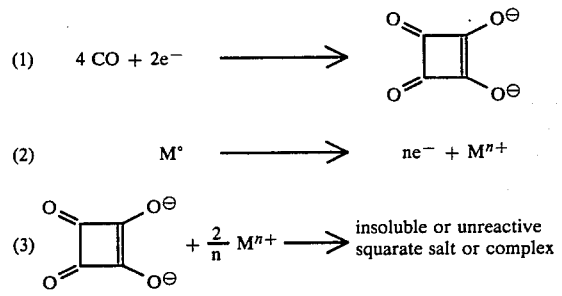

As in the patented process this process involves first creating an operational environment which substantially avoids oxidation in the anodic zone of the reaction products of carbon monoxide, as well as reduction in the cathodic zone of those products obtained from the anodic reaction section. Thus certain operational parameters must be established in order to prevent the products of anodic reaction and/or the anodic reaction itself from substantially interfering with the products of the cathodic reaction or with the cathodic reaction itself, and vice versa. Such non-interference can be achieved by selecting from a variety of several different conventional methods, some of which are described in U.S. Pat. No. 3,833,489, those cited herein being set forth as simply illustrative. For instance, the use of baffles, diaphragms, or the forced circulation of the solution inside the cell, by the careful selection of conditions so as to yield only the formation of chemically inert oxidation products, or by the formation of anodic oxidation products which are then continuously removed from the anolite, are operable. Of course, combinations of these techniques may also be possible.

Although the reductive electrochemical cyclotetramerization of CO to the squarate anion can be achieved to some degree under a wide variety of operational conditions, e.g. differing corrosion resistances of the anode (corrodible or noncorrodible), the use of direct or alternating current, different temperature and pressure conditions, and the differing composition of the chemical solvent, this invention is primarily concerned with the surprising improvement attained by the use of a particular class of solvents in the system described in U.S. Pat. No. 3,833,489 and in related publications. It has been found that, contrary to the teachings of these references, aliphatic nitriles containing between 2 and about 8 carbon atoms can be used to give particularly effective results as solvents in the aforementioned reaction. In particular, it has been discovered that squaric acid is generated in an insoluble form, probably as a metal salt, when carbon monoxide is electrochemically reduced in anhydrous nitrile solvent medium with corroding metal anodes; the preferred nitrile solvent being selected from the group consisting of isobutyronitrile, n-butyronitrile, propionitrile and acetonitrile. Best results are obtained when substantially anhydrous isobutyronitrile is used, and current efficiencies of about 50% have been attained. Although other aliphatic nitriles may be operative, economic considerations probably make their usage unlikely, and aromatic nitriles do not appear to be nearly as effective. Current efficiencies have been attained in the formation of squaric acid in acetonitrile that are 300% higher than previously reported. Furthermore, nitrile solvents are particularly useful since the squarate product formed, which is produced substantially in the solid state by the method of this invention, is much more readily and easily separated by centrifugation, filtration or other separation techniques than are those formed in, for example, amide medium. Additionally, the improved separation properties of the resultant product mixture make it possible to recycle the starting raw materials, such as the electrolyte, and thus could conceivably make a continuous, as well as a batch process, operable. In contrast, the product formed in the system reported by the Italians has been found to be far more difficult to separate. To date no simple, clean separation of squarate from DMF, except through the distillation of the solvent, has been attained, and this method leaves behind all non-volatiles.

Although the process described herein can be used with either a corrodible or noncorrodible anode, following the teachings of U.S. Pat. No. 3,833,489, in the preferred embodiment it is desired to operate using a corrodible anode primarily for ease in process engineering simplicity. It has been found that, depending upon the choice of solvent used, the particular anode metal chosen can be critical for effective operation. For example, squaric acid has been formed with current efficiencies of 40 to 50% when using magnesium or aluminum anodes, yet barely at all when using titanium, and not at all with soft steel. Although it is not desired to be bound by theory, this may be due to the differences in the solubility of the metal squarate salts formed in each solvent. This is because an insoluble salt prevents anodic oxidation of squarate formed at the cathode. Alternatively, these results may be due to the differences in the oxidation potentials of these anode metals in the chosen nitrile solvent, since the metal must oxidize more readily than any soluble squarate salt will oxidize, in order to prevent the anodic oxidation of squarate. Although the precise mechanism is uncertain, it is believed that the conditions existing at the anode are probably due to some combination of at least one of these factors. Anodes particularly suitable for use as corroding metal anodes in aliphatic nitrile solvents are aluminum, magnesium and tin, as well as alloys and/or mixtures thereof, and particularly aluminum and magnesium, whereas titanium and iron have been found not to be effective. Other metals may also be effective and are within the scope of this invention, such as copper, lead, zinc, indium and the like.

In contrast, the cathode material has been found to only slightly effect the electrolytical reaction. Suitable cathodes can be formed from steel and aluminum alloys and/or mixtures thereof, with steel being particularly useful. However, in the broadest embodiment, almost any material can be operable as the cathode.

In order to enhance the conductivity of the solution there may be added thereto one or more auxiliary electrolytes, such as a tetraalkylammonium halide and other electrolytes described as useful in U.S. Pat. No. 3,833,489. Tetraalkylammonium halides are most effective.

The current density employed in the electrolysis reaction can vary over a wide range depending upon the particular system parameters employed. The electrical current used can be either direct or alternating current, with the direct being preferred.

The temperature of the reaction system can range over the complete liquid range of the particular solvent employed, e.g., from the temperature just above the freezing point up to the temperature at the boiling point of the particular nitrile solvent present, with a temperature range of about 10°–50° C. particularly preferred, and the system can be operated at pressures ranging from substantially atmospheric up to about 420 atmospheres, with pressures of between about 30–150 atmospheres being particularly preferred although, within certain limits, the higher the pressure, the better the conversion attained. A particularly interesting aspect of the invention is the surprising unpredictability of the effectiveness of a particular solvent. It was discovered that a significant number of the claimed solvents of U.S. Pat. No. 3,833,489 are substantially inoperative, together with several common polar electrochemical solvents, such as propylene carbonate and sulfolane.

The following examples are provided to illustrate the invention in accordance with the principles of this invention but are not construed as limiting the invention in any way except as indicated by the appended claims.

EXAMPLES

In the following examples, the precise amount of squaric acid present was determined by HPLC-UV techniques using an Aminex HPX87 column (Bio Rad Laboratories) with a 0.001N $H_2SO_4$ mobile phase (flow rate=0.6 ml/min). The column temperature was maintained at 65° C. Squaric acid was detected spectrophotometrically at 270 nm. Retention time was approximately 6 to 7 minutes. The apparatus described in example 1 is also used for examples 2, 3, 4 and 9–14.

EXAMPLE 1

This example illustrates the coupling of CO to squaric acid in isobutyronitrile solvent with a $Bu_4NBr$ electrolyte and an aluminum anode at 1000 psig CO.

Isobutyronitrile (60 ml) and $Bu_4NBr$ (3.0 g) were charged to a 200 ml Paar bomb equipped with a magnetic stirring vane. An aluminum rod was connected via a bulkhead electrical adapter to the positive pole of a power supply. The bomb was sealed, connected to the negative pole of the power supply, and pressurized with CO to 1000 psig. Direct current (approximately 100 mA) was applied until 18.6 mF charge had passed. The gas was vented and the resultant solids were separated from the electrolysis mixture by centrifugation, washed with isobutyronitrile, and dried (2.81 g). Analysis of the solids showed that they contained 12.82 wt. % squaric acid (0.36 g, 34% current efficiency).

EXAMPLE 2

This example illustrates the coupling of CO to squaric acid in isobutyronitrile with a $Bu_4NI$ electrolyte.

Isobutyronitrile (60 mL) and $Bu_4NI$ (4.0 g) were stirred under 1000 psig CO and direct current (approximately 100 mA) was applied until 24.8 mF of charge had passed. The gas was vented and the resultant solids were separated from the electrolysis mixture by filtration, washed with isobutyronitrile, and dried (2.69 g). Analysis of these solids showed that they contained 22.04 wt. % squaric acid (0.59 g, 42% current efficiency).

EXAMPLE 3

This example illustrates the coupling of CO to squaric acid in a specially dried isobutyronitrile-$Bu_4NI$ solution.

$Bu_4NI$ (5.0 g) was dissolved in isobutyronitrile (100 mL) and this solution was stored over activated 4A sieves for 4 days in a darkened room. The dried electrolyte solution (60 mL) was then stirred under 1000 psig CO and a direct current (approximately 100 mA) was passed until 24.0 mF of charge had passed. The gas was vented and the resultant solids were separated by filtration and air dried (2.59 g). Analysis of these solids showed that they contained 23.8 wt. % squaric acid (0.62 g; 45% current efficiency).

EXAMPLE 4

This example illustrates the coupling of CO to squaric acid in wet isobutyronitrile with $Bu_4NBr$.

Isobutyronitrile (60 mL), distilled $H_2O$ (0.5 mL), and $Bu_4NBr$ (3.0 g) were stirred under 1000 psig CO and direct current (approximately 100 mA) was passed until 15.9 mF charge had passed. The gas was then vented and the electrolysis mixture was analyzed for squaric acid (0.005 wt. %, 0.002 g, 0.2% current efficiency).

EXAMPLE 5

This example illustrates the coupling of CO to squaric acid using a magnesium anode.

The same apparatus was used as in Example 1, except that a magnesium rod was used as an anode, rather than an aluminum one. Isobutyronitrile (60 mL) and $Bu_4NBr$ (3.0 g) were stirred under 1000 psig CO and direct current (approximately 100 mA) was applied until 26.0 mF charge had passed. The gas was vented and the resultant solids were separated from the electrolysis mixture by centrifugation, washed with isobutyronitrile, and dried (3.53 g). Analysis of these solids showed that they contained 11.48 wt. % squaric acid (0.41 g, 27% current efficiency).

EXAMPLE 6

This example illustrates the coupling of CO to squaric acid using $Bu_4NI$ electrolyte with a magnesium anode at 1400 psig CO.

The same apparatus was used as in Example 1, with the substitution of a magnesium rod as an anode, in place of an aluminum one. Isobutyronitrile (60 mL, distilled and dried over activated 4A sieves) and $Bu_4NI$ (2.0 g) were stirred under 1400 psig CO and a direct current (approximately 100 mA) was applied until 27.2 mF of charge had passed. The gas was vented and the resultant solids were separated from the electrolysis mixture by filtration and dried under an air stream (2.36 g). Analysis of these solids showed that they contained 27.54 wt. % squaric acid (0.65 g, 42% current efficiency). The filtered electrolyte solution contained no squarate and was next used, without further handling, in Example 7.

EXAMPLE 7

This example illustrates the coupling of CO to squaric acid in a previously used electrolyte solution.

The same apparatus was used as in Example 6. The filtered electrolyte solution used in example 6 was stirred under 1400 psig CO and a direct current (approximately 100 mA) was applied until 22.2 mF of charge had passed. The gas was vented and the resultant solids were separated from the electrolysis mixture by filtration and dried under an air stream (2.46 g). Analysis of these solids showed that they contained 25.82 wt. % squaric acid (0.63 g, 50% current efficiency). The filtered electrolyte solution contained no squarate.

EXAMPLE 8

This example illustrates the coupling of CO to squaric acid using a titanium anode.

The same apparatus was used as in Example 1, with a substitution of a titanium rod as an anode, rather than an aluminum one. Isobutyronitrile (60 mL) and $Bu_4NBr$ (3.0 g) were stirred under a 1000 psig CO and direct current (approximately 100 mA) was applied for 6 h. The gas was vented and the electrolysis mixture was then analyzed for squaric acid (0.016 wt. %, 0.0081 g).

EXAMPLE 9

This example illustrates the coupling of CO to squaric acid in propionitrile solvent.

Propionitrile (60 mL) and $Bu_4NBr$ (3.0 g) were stirred under 1000 psig CO and a direct current (100 mA, initially) was applied until 35.0 mF charge had passed. The gas was vented and the resultant solids were separated from the electrolysis mixture by centrifugation, washed with propionitrile, and dried (3.86 g). Analysis of these solids showed that they contained 8.36 wt. % squaric acid (0.32 g, 16% current efficiency).

EXAMPLE 10

This example illustrates the coupling of CO to squaric acid in acetonitrile.

Acetonitrile (60 mL) and $Bu_4NBr$ (3.0 g) were stirred under 1000 psig CO and a direct current (approximately 200 mA) was applied for 5 h. The gas was vented and the electrolysis mixture was then analyzed for squaric acid (0.31 wt. %, 0.16 g 8.0% current efficiency).

EXAMPLE 11

This example illustrates the coupling of CO to squaric acid in n-butyronitrile.

n-Butyronitrile (60 mL) and $Bu_4NBr$ (3.0 g) were stirred under 1000 psig CO and a direct current (approximately 100 mA) was applied until 11.7 mF charge had passed. The gas was vented and the resultant electrolysis mixture was analyzed for squaric acid (0.20 wt. %, 0.10 g, 16% current efficiency).

EXAMPLE 12

This example illustrates the coupling of CO to squaric acid in pivalonitrile.

Pivalonitrile (60 mL) and $Bu_4NBr$ (3.0 g) were stirred under 1000 psig CO and a direct current (approximately 100 mA) was applied for 5.5 h. The gas was vented and the resultant electrolysis mixture was analyzed for squaric acid (0.08 wt. %, 0.04 g 2.0% current efficiency.

EXAMPLE 13

This example illustrates the coupling of CO to squaric acid in valeronitrile.

Valeronitrile (60 mL) and $Bu_4NBr$ (3.0 g) were stirred under 1000 psig CO and a direct current (30 to 100 mA) was applied until 10.3 mF charge had passed. The gas was vented and the resultant solids were separated from the electrolysis mixture by filtration, washed with valeronitrile, and dried (0.93 g). Analysis of these solids showed that they contained 5.82 wt. % squaric acid (0.05 g, 9.2% current efficiency).

EXAMPLE 14

This example illustrates the coupling of CO to squaric acid in benzonitrile.

Benzonitrile (60 mL) and $Bu_4NBr$ (3.0 g) were stirred under 1000 psig CO and a direct current (approximately 100 mA) was applied for 5.5 h. The gas was vented and the resultant electrolysis mixture was analyzed for squaric acid. No squaric acid was detected.

I claim:

1. In a method for preparing squaric acid, its complexes and/or salts, the method comprising passing an electrical current through a solution of carbon monoxide maintained at a temperature ranging from the freezing point up to the boiling point of the particular solvent present, the solution further maintained at pressures ranging from atmospheric up to about 420 atmospheres, wherein the electrolytic cathodic reductive cyclotetramerization of carbon monoxide is undertaken, the reaction being carried out under conditions of substantial separation or non-interference of the anodic reactions and reaction products from the cathodic reactions and reaction products, wherein the improvement comprises the usage of an anhydrous aliphatic nitrile solvent containing from 3 to 8 carbon atoms, the formed squarate being particularly adaptable to efficient separation methods.

2. The method of claim 1 wherein the nitrile solvent is selected from the group consisting of isobutyronitrile, n-butyronitrile and propionitrile.

3. The method of claim 2 wherein the solvent is isobutyronitrile.

4. The method of claim 1 wherein direct current is employed as the electrical current.

5. The method of claim 1 wherein the anode is composed of a corrodible conductive metal in the electrolysis environment.

6. The method of claim 5 wherein the conductive metal is selected from the group consisting of aluminum, magnesium, and tin, and alloys and/or mixtures thereof.

7. The method of claim 5 wherein the cathode is made from a metal conductor which is substantially non-corrodable and is substantially chemically inert with respect to the electrolysis conditions.

8. The method of claim 1 wherein the separation of the catholite from the anolite is affected by means of baffles or diaphragms.

9. The method of claim 1 wherein separation of the catholite from the anolite is attained by separately circulating each fluid.

10. The method of claim 1 wherein the non-interference of the reaction products in the catholite from those in the anolite is attained through the formation of products which are chemically inert under the electrolysis conditions.

11. The method of claim 1 wherein the non-interference of the reaction products in the catholite with those in the anolite is achieved through the formation of products which are insoluble in the reaction medium.

12. The method of claim 1 wherein the reaction is carried out at a temperature ranging from about 10° C. to about 50° C.

13. The method of claim 1 wherein the reaction is carried out at a pressure from about 30 to 150 atm.

14. The method of claim 1 wherein the anodic oxidation products are liquid.

15. The method of claim 1 wherein the anodic oxidation products are gaseous.

16. The method of claim 1 wherein the anodic oxidation products are substantially non-electrolytes.

17. The method of claim 1 wherein the formed squarate products are separated from the reaction mixture by filtration.

18. The method of claim 1 wherein the formed squarate products are separated from the reaction mixture by centrifugation.

19. The method of claim 1 wherein the electrolyte can be reused after squaric acid preparation.

* * * * *

UNITED STATES PATENT AND TRADEMARK OFFICE

CERTIFICATE OF CORRECTION

PATENT NO. : 4,461,681

DATED : July 24, 1984

INVENTOR(S) : James J. Barber

It is certified that error appears in the above-identified patent and that said Letters Patent is hereby corrected as shown below:

Col. 1, line 34 - change

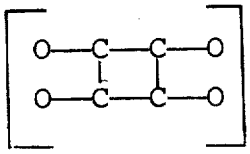

to

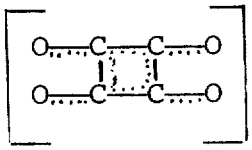

Signed and Sealed this

Thirtieth Day of July 1985

[SEAL]

*Attest:*

DONALD J. QUIGG

*Attesting Officer* *Acting Commissioner of Patents and Trademarks*